US008126383B2

(12) United States Patent
Kagawa

(10) Patent No.: US 8,126,383 B2
(45) Date of Patent: Feb. 28, 2012

(54) FIXING APPARATUS HAVING AN ENHANCED PLANAR HEAT GENERATING BODY, AND IMAGE FORMING APPARATUS INCLUDING THE SAME

(75) Inventor: Toshiaki Kagawa, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 396 days.

(21) Appl. No.: 12/412,427

(22) Filed: Mar. 27, 2009

(65) Prior Publication Data

US 2009/0245900 A1 Oct. 1, 2009

(30) Foreign Application Priority Data

Mar. 31, 2008 (JP) ..... 2008-090979

(51) Int. Cl.
*G03G 15/20* (2006.01)

(52) U.S. Cl. ..... 399/329; 399/69

(58) Field of Classification Search ..... 399/69, 399/329

See application file for complete search history.

(56) References Cited

U.S. PATENT DOCUMENTS 4,755,849 A * 7/1988 Tarumi et al. ..... 399/331
2005/0163523 A1* 7/2005 Omata et al. ..... 399/69

FOREIGN PATENT DOCUMENTS

JP 05-19652 1/1993
JP 10-307496 11/1998
JP 11-287238 10/1999
JP 2001-005313 1/2001
JP 2002-333788 11/2002
JP 2003-142233 5/2003
JP 2004-335397 A 11/2004
JP 2005-339840 A 12/2005
JP 2006012444 A * 1/2006
JP 2006-072182 A 3/2006
JP 2008-170887 7/2008

OTHER PUBLICATIONS

English Translation to Kimura et al., JP 2006012444 A.*

* cited by examiner

*Primary Examiner* — Ryan Walsh
(74) *Attorney, Agent, or Firm* — Renenr, Otto, Boisselle & Sklar, LLP

(57) ABSTRACT

A planar heat-generating body 42 of a fixing apparatus of the present invention includes (i) a resistive heat-generating body 43*a* containing small heat-generating bodies electrically connected in parallel and aligned in a direction perpendicular to a direction in which a fixing belt 32 moves and (ii) a PTC element and a corresponding small heat-generating body being provided to be connected in series with a power source 36, the PTC element having a resistance value increasing at a predetermined temperature or higher. The PTC element 37 and the small heat-generating body are provided in an area corresponding to a non-sheet passing area of the fixing belt 32, the non-sheet passing area being an area where a smallest-size sheet does not pass, the smallest-size sheet being smallest among sheets that the fixing apparatus deals with. This allows for prevention of a temperature increase in the non-sheet passing area with a simple arrangement.

12 Claims, 11 Drawing Sheets

FIXING APPARATUS HAVING AN ENHANCED PLANAR HEAT GENERATING BODY, AND IMAGE FORMING APPARATUS INCLUDING THE SAME

This Nonprovisional application claims priority under 35 U.S.C. §119(a) on Patent Application No. 2008-090979 filed in Japan on Mar. 31, 2008, the entire contents of which are hereby incorporated by reference.

TECHNICAL FIELD

The present invention relates to (i) a fixing apparatus used in an electrophotographic image forming apparatus and (ii) an image forming apparatus including the fixing apparatus.

BACKGROUND ART

As a fixing apparatus used in an electrophotographic image forming apparatus such as a copying machine and a printer, a heat roller type fixing apparatus is frequently used. The heat roller type fixing apparatus includes a pair of rollers (a fixing roller and a pressure roller) pressing each other. Further, both or either one of the pair of rollers internally includes heating means realized by a halogen heater or the like. The heating means heats the pair of rollers to a predetermined temperature (a fixing target temperature). After that, a recording sheet on which an unfixed toner image is formed is carried to a pressure area (a fixing nip area) between the pair of rollers, and then the recording sheet is caused to pass through the pressure area. Thus, a toner image is fixed on the recording sheet due to heat and pressure applied thereto.

Incidentally, a fixing apparatus included in a color image forming apparatus generally uses an elastic roller. The elastic roller is a fixing roller provided with, on its surface, an elastic layer which is made from silicon rubber and/or the like. In the case where the elastic roller is used as the fixing roller, a surface of the fixing roller elastically deforms according to an uneven surface of an unfixed toner image and is in contact with a toner image so as to cover the toner image. This allows a color unfixed toner image whose toner amount is larger than that of a monochrome unfixed toner image to be favorably fixed by using heat. Further, due to strain release of the elastic layer which occurs in a fixing nip area, it is possible to improve a releasing property with respect to color toner, which is more likely to offset than monochrome toner. Furthermore, the fixing nip area has a nip shape protruding upward (i.e., toward the fixing roller side), that is, a so-called inverse nip shape. This makes it possible to more favorably separate a sheet from the fixing roller, thereby allowing the sheet to be separated without using any separation means such as a separation claw (self-stripping). This prevents insufficient image formation which is caused by the separation means.

In order to realize a higher process speed, the fixing apparatus included in such the color image forming apparatus is required to have a greater nip width for the fixing nip area. As means for increasing a nip width, two methods are possible. One is a method of increasing a thickness of the elastic layer of the fixing roller, and the other is a method of increasing a diameter of the fixing roller.

Increasing the thickness of the elastic layer of the fixing roller, however, causes the following problem: The elastic layer has a low heat conductivity. Therefore, in a case where the fixing roller internally includes the heating means as in the conventional arrangement and the fixing roller includes the elastic layer having a large thickness, a temperature of the fixing roller cannot follow an increased process speed due to insufficient heat supply.

On the other hand, increasing the diameter of the fixing roller reduces curvatures of the rollers forming the fixing nip area, thereby increasing the fixing nip area. Increasing the diameter of the fixing roller, however, requires the rollers to increase its heat capacity, thereby causing such a problem that (i) warm-up time is extended and (ii) electric power consumption is increased.

In order to solve these problems, for example, Patent Literature 1: Japanese Patent Application Publication, Tokukaihei, No. 10-307496 (Publication Date: Nov. 17, 1998) discloses a belt type fixing apparatus included in a color image forming apparatus, in which belt type fixing apparatus (i) a heating roller, which is heating means, is provided outside a fixing roller, (ii) a fixing belt is set around the fixing roller and the heating roller, and (iii) the fixing roller and a pressure roller press each other via the fixing belt.

In the belt type fixing apparatus, the fixing belt having a small heat capacity is heated. Therefore, the belt type fixing apparatus provides a short warm-up time. Further, with the belt type fixing apparatus, it is not necessary to integrate a heating source such as a halogen lamp into the fixing roller. This makes it possible to increase a thickness of a low-hardness elastic layer made from sponge rubber and/or the like, thereby securing a large nip width.

Further, for example, a belt type fixing apparatus disclosed in Patent Literature 2: Japanese Patent Application Publication, Tokukai, No. 2002-333788 (Publication Date: Nov. 22, 2002) is a planar heat-generating belt type fixing apparatus in which a heat-generating body is used as heating means. In the planar heat-generating belt type fixing apparatus, (i) the heating means has a smaller heat capacity than that of a conventional heating roller, and (ii) a heating member, forming a planar heat-generating body (heating means), itself generates heat. This improves heat responsiveness, compared with the conventional fixing apparatus in which the heating roller is heated indirectly by means of the halogen lamp. This attains (i) a further reduction in warm-up time and (ii) further energy saving.

The conventional planar heat-generating belt type fixing apparatus, however, has the following problems: In a case where small-size sheets whose widths are smaller than a maximum sheet passing width are fed in succession, an area where the small-size sheets has passed is heated by the heating member so as to recover heat lost from the area, thereby returning to its original temperature. On the other hand, regardless of the fact that no heat is lost from a non-sheet passing area which is outside the area where the small-size sheets have passed, the non-sheet passing area is heated by the heating member. This increases a temperature of the non-sheet passing area excessively. This may cause a deterioration of the fixing belt or the fixing roller, or may cause a high-temperature offset when a regular-size sheet is fed immediately after the small-size sheets are fed.

Patent Literature 2 deals with this problem by dividing a system into (i) a system for generating heat only in a center area (when viewed in a longitudinal direction of the heat-generating body) of the heat-generating body and (ii) a system for generating heat only in side areas (when viewed in the longitudinal direction of the heat-generating body) of the heat-generating body. This arrangement, however, requires temperature sensors (such as thermistors) and safety switches (such as thermostats) as much as the number of systems thus divided. With this arrangement, the system becomes very complicated.

Incidentally, Patent Literature 3: Japanese Patent Application Publication, Tokukaihei, No. 5-19652 (Publication Date: Jan. 29, 1993) discloses a technique for preventing a temperature increase in a non-sheet passing area in such a manner that an electrode is formed by using, as a heating body, a self-temperature-control heat-generating body having positive temperature coefficient (PTC) characteristics and thereby current is caused to flow in a direction in which a heat-resistant film (fixing belt) moves. However, as disclosed in Patent Literature 3, a heat-generating body having the PTC characteristics at a high temperature of 200° C. or higher can only be the one made from ceramic materials (sintered moldings) such as a barium titanate. It is difficult to process these materials into the one whose shape corresponds to a shape of a planar heat-generating body, which has a curvature and a large width, as seen in the planar heat-generating belt type fixing apparatus.

SUMMARY OF INVENTION

The present invention was made in view of the foregoing conventional problems, and an objective of the present invention is to prevent, with a simple arrangement, a temperature increase in a non-sheet passing area in (i) a belt type fixing apparatus using a planar heat-generating body and (ii) an image forming apparatus including the fixing apparatus.

In order to solve the foregoing problems, a fixing apparatus according to the present invention includes: a fixing member which is rotatable; a heating member which is curved and includes a planar heat-generating body; and a fixing belt which is endless and moves while getting in contact with the fixing member and the heating member, the fixing member and the heating member being arranged such that a concave curved surface of the heating member faces the fixing member, the planar heat-generating body, including: a resistive heat-generating body containing a plurality of small heat-generating bodies which are electrically connected in parallel and are aligned in a direction perpendicular to a direction in which the fixing belt moves; and (i) positive temperature coefficient elements and whole of or some of the plurality of small heat-generating bodies being provided, respectively, so as to be connected in series with a power source or (ii) a single positive temperature coefficient element and some of the plurality of small heat-generating bodies being provided so as to be connected in series with the power source, in an area corresponding to a non-sheet passing area of the fixing belt, the non-sheet passing area being an area where a smallest-size sheet does not pass, the smallest-size sheet being smallest among sheets that the fixing apparatus deals with, the positive temperature coefficient element(s) having a resistance value increasing at a predetermined temperature or higher.

Accordingly, by providing (i) the resistive heat-generating body containing the plurality of small heat-generating bodies which are electrically connected in parallel and are aligned in the direction perpendicular to the direction in which the fixing belt moves and (ii) (a) the PTC elements and the whole of or the some of the plurality of small heat-generating bodies being provided, respectively, so as to be connected in series with the power source or (b) the single PTC element and the some of the plurality of small heat-generating bodies being provided so as to be connected in series with the power source, the positive temperature coefficient element(s) having a resistance value increasing at a predetermined temperature or higher, it is possible to realize a planar heat-generating body having PTC characteristics.

In a case where small-size sheets are fed in succession, in an area of the planar heat-generating body which area corresponds to a non-sheet passing area of the fixing belt, there is no heat transfer to a sheet. Therefore, a temperature of the non-sheet passing area increases excessively. However, the PTC element connected to the small heat-generating body provided in the area corresponding to the non-sheet passing area operates as follows: When a temperature of the area corresponding to the non-sheet passing area reaches the predetermined value, the PTC element increases its resistance value. This reduces current supplied to the small heat-generating body in the area, thereby causing the small heat-generating body in the area to stop generating heat. Thereby, the temperature increase in the non-sheet passing area of the fixing belt is prevented.

Further, with the foregoing arrangement, the PTC element(s) is(are) provided in a power supply path from the power source to, among the plurality of small heat-generating bodies, the small heat-generating body provided in the area corresponding to the non-sheet passing area of the fixing belt, the non-sheet passing area being an area where a smallest-size sheet does not pass, the smallest-size sheet being smallest among sheets that the fixing apparatus deals with. This makes it possible to prevent the temperature increase in the non-sheet passing area, regardless of the size of a sheet which is fed. This allows the fixing belt to have a uniform temperature distribution at any time. Further, it is not necessary to provide the PTC element in an area corresponding to a sheet passing area where the smallest-size sheet passes. This makes it possible to reduce a cost.

As is clear from the descriptions given above, the arrangement according to the present invention makes it possible to prevent, with a simple arrangement, an excessive temperature increase in the non-sheet passing area, the excessive temperature increase occurring when small-size sheets are fed in succession. This prevents (i) a deterioration of the fixing belt and the fixing roller and (ii) occurrence of a high-temperature offset, thereby providing a high-quality fixing apparatus.

Further, a fixing apparatus according to the present invention includes: a fixing member which is rotatable; a heating member which is curved and includes a planar heat-generating body; and a fixing belt which is endless and moves while getting in contact with the fixing member and the heating member, the fixing member and the heating member being arranged such that a concave curved surface of the heating member faces the fixing member, the planar heat-generating body, including: a resistive heat-generating body which extends in a direction perpendicular to a direction in which the fixing belt moves; a plurality of small electrodes, provided on one side surface of the resistive heat-generating body in a direction in which the resistive heat-generating body extends, which are electrically separated from each other and cause current to flow through the resistive heat-generating body in a direction parallel to the direction in which the fixing belt moves; an electrode, provided on the other side surface of the resistive heat-generating body, which is grounded; and (i) positive temperature coefficient elements and whole of or some of the plurality of small electrodes being provided, respectively, so as to be connected in series with a power source or (ii) a single positive temperature coefficient element and some of the plurality of small electrodes being provided so as to be connected in series with the power source, in an area corresponding to a non-sheet passing area of the fixing belt, the non-sheet passing area being an area where a smallest-size sheet does not pass, the smallest-size sheet being smallest among sheets that the fixing apparatus deals with, the positive temperature coefficient element(s) having a resistance value increasing at a predetermined temperature or higher.

Accordingly, by providing (i) the resistive heat-generating body which extends in the direction perpendicular to the direction in which the fixing belt moves, (ii) the plurality of small electrodes, provided on the one side surface of the resistive heat-generating body in the direction in which the resistive heat-generating body extends, which are electrically separated from each other and cause current to flow through the resistive heat-generating body in the direction parallel to the direction in which the fixing belt moves, (iii) the electrode, provided on the other side surface of the resistive heat-generating body, which is grounded, and (iv) (a) the PTC elements and the whole of or the some of the plurality of small electrodes being provided, respectively, so as to be connected in series with the power source or (b) the single PTC element and the some of the plurality of small electrodes being provided so as to be connected in series with the power source, the positive temperature coefficient element(s) having a resistance value increasing at the predetermined temperature or higher, it is possible to provide a planar heat-generating body having PTC characteristics.

In a case where small-size sheets are fed in succession, in an area of the planar heat-generating body which area corresponds to a non-sheet passing area of the fixing belt, there is no heat transfer to a sheet. Therefore, a temperature of the non-sheet passing area increases excessively. However, the PTC element connected to the small electrode provided in the area corresponding to the non-sheet passing area operates as follows: When a temperature of the area corresponding to the non-sheet passing area reaches the predetermined temperature, the PTC element increases its resistance value. This reduces current supplied to the small electrode in the area, thereby stopping heat-generation in the area. Thereby, the temperature increase in the non-sheet passing area is prevented. Further, extending the resistive heat-generating body in the direction perpendicular to the direction in which the fixing belt moves prevents effects caused by unevenness in temperature results from gaps made in a case where the resistive heat-generating body is divided into the plurality of small heat-generating bodies.

Further, the PTC element is provided in the power supply path from the power source to, among the plurality of small electrodes, a small electrode provided in the area corresponding to the non-sheet passing area of the fixing belt, the non-sheet passing area being an area where a smallest-size sheet does not pass, the smallest-size sheet being smallest among sheets that the fixing apparatus deals with. This makes it possible to prevent the temperature increase in the non-sheet passing area regardless of the size of the sheet which is fed. This allows the fixing belt to have a uniform temperature distribution at any time. Further, it is not necessary to provide the PTC element in the area corresponding to the sheet passing area where the smallest-size sheet passes. This makes it possible to reduce a cost.

As is clear from the descriptions given above, the arrangement according to the present invention makes it possible to prevent, with a simple arrangement, an excessive temperature increase in the non-sheet passing, the excessive temperature increase occurring when small-size sheets are fed in succession. This prevents (i) a deterioration of the fixing belt and the fixing roller and (ii) occurrence of a high-temperature offset, thereby providing a high-quality fixing apparatus.

Additional objects, features, and strengths of the present invention will be made clear by the description below. Further, the advantages of the present invention will be evident from the following explanation in reference to the drawings.

DESCRIPTION OF EMBODIMENTS

First Embodiment

Figure 2:
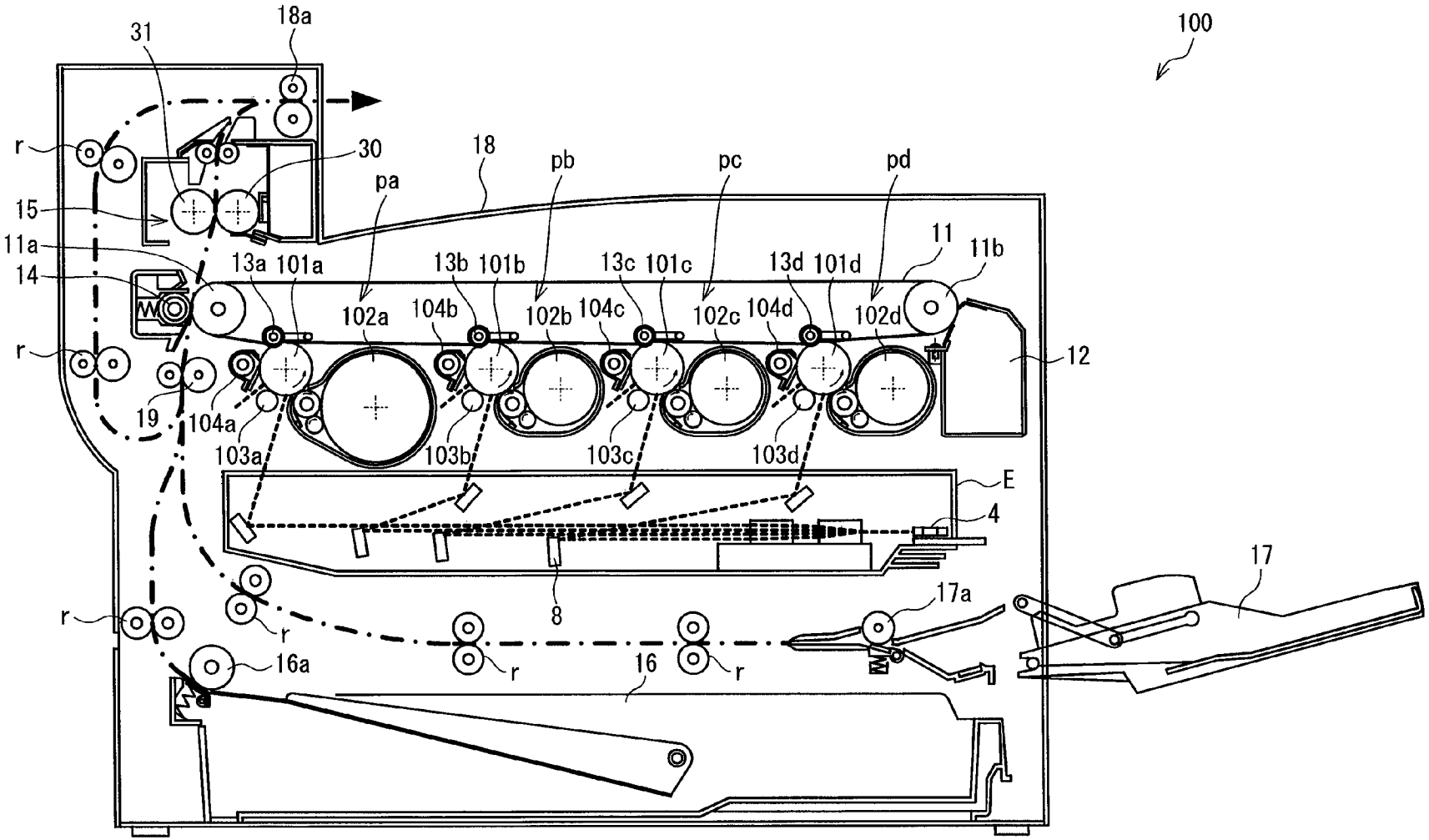
FIG. 2 is a view schematically illustrating an arrangement of an image forming apparatus according to an embodiment of the present invention.

The following describes one embodiment of the present invention. Note that the following embodiment is one example exemplifying the present invention, and by no means limits a technical scope of the present invention. The below-described embodiment mainly deals with a case where the present invention is applied to a color multifunctional peripheral/copying machine and a color printer. However, the present invention may also be applied to a monochrome multifunctional peripheral/copying machine and a monochrome printer. FIG. 2 is a schematic view illustrating an internal arrangement of an image forming apparatus 100. The image forming apparatus 100 functions as a dry electrophotographic color image forming apparatus and also functions as a printer for forming a color image or a monochrome image on a sheet (a recording material, a transfer medium, or a recording sheet) in accordance with (i) image data transmitted from terminal devices connected to the image forming apparatus 100 via a network or (ii) image data scanned by a scanner connected to the image forming apparatus 100 via the network.

As illustrated in FIG. 2, the image forming apparatus 100 according to the present embodiment includes an optical system unit E, four visual image forming units pa, pb, pc, and pd, an intermediate transfer belt 11, a second transfer unit 14, a fixing apparatus (fixing unit) 15, an internal sheet feeding unit 16, and a manual sheet feeding unit 17.

In the visual image forming unit pa, a charging unit 103*a*, a developing unit 102*a*, and a cleaning unit 104*a* are provided around a photoreceptor 101*a*, which is a toner image bearing member. Further, in the visual image forming unit pa, a first transfer unit 13*a* is provided via the intermediate transfer belt 11. The other three visual image forming units pb, pc, and pd have the same arrangement as that of the visual image forming unit pa. Members having the same function are given (i) the same reference numeral and (ii) alphabetical characters (b, c, d) corresponding to the respective visual image forming units. The visual image forming units pa, pb, pc, and pd contain toner of different colors, that is, yellow (Y), magenta (M), cyan (C), and black (B), respectively.

The optical system unit E is provided so that beams are transmitted from a light source 4 to the four photoreceptors 101*a*, 101*b*, 101*c*, and 101*d*. To the optical system E, pixel signals respectively corresponding to a yellow component, a magenta component, a cyan component, and a black component in image data are inputted. In accordance with the pixel signals thus inputted, the light source 4 emits beams. The beams thus emitted are reflected by a mirror 8, and expose the photoreceptors 101*a*, 101*b*, 101*c*, and 101*d* each of which is charged, thereby forming an electrostatic latent image.

The intermediate transfer belt 11 is provided such that tension rollers 11*a* and 11*b* prevent the intermediate transfer belt 11 from being loosened. A used toner box 12 for collecting toner remaining on the intermediate transfer belt 11 and a second transfer unit 14 are provided such that the used toner box 12 and the second transfer unit 14 get in touch which the intermediate transfer belt 11. The used toner box 12 is provided on the tension roller 11*b* side, and the second transfer unit 14 is provided on the tension roller 11*a* side.

In the fixing unit (fixing apparatus) 15, a fixing roller 30 and a pressure roller 31 press each other at a predetermined pressure by means of pressure means (not illustrated). The fixing roller 30 and the pressure roller 31 are provided downstream of the second transfer unit 14. The present embodiment includes the fixing apparatus 15 of a planar heat-generating belt type, which will be described in detail later.

The following describes how an image is formed by the image forming apparatus 100. A surface of the photoreceptor 101*a* is uniformly charged by the charging unit 103*a*. Then, the surface of the photoreceptor 101*a* is subjected to laser exposure by means of the optical system unit E in accordance with image information, so that an electrostatic latent image is formed thereon. The charging unit 103*a* of the present embodiment uses a charging roller method so as to uniformly charge the surface of the photoreceptor 101*a* while generation of ozone is suppressed as much as possible. After that, the developing unit 102*a* develops a toner image in accordance with the electrostatic latent image on the photoreceptor 101*a*. Subsequently, the toner image, which is made visible, is transferred onto the intermediate transfer belt 11 by means of the first transfer unit 13*a* to which a bias voltage having a polarity reverse to a charging polarity of the toner is applied.

The other three visual image forming units pb, pc, and pd also operate in the same manner as described above, thereby sequentially transferring toner images onto the intermediate transfer belt 11. The toner image on the intermediate transfer belt 11 is carried to the second transfer unit 14. A carrying roller 19 carries (i) a recording sheet fed from a sheet feeding roller 16*a* of the internal sheet feeding unit 16 or (ii) a recording sheet fed from a sheet feeding roller 17*a* of the manual sheet feeding unit 17. Then, the second transfer unit 14 applies, onto the recording sheet thus fed, the bias voltage having the polarity reverse to the charging polarity of the toner, so that the toner image is transferred to the recording sheet. The toner image on the recording sheet is carried to the fixing unit 15. While the toner image on the recording sheet passes through the fixing unit 15, heat and pressure are sufficiently applied to the toner image on the recording sheet, so that the toner image is molten and fixed on the recording sheet. Then, a carrying roller 18*a* discharges, to the outside of the image forming apparatus 100, the recording sheet on which the fixing process with respect to the toner image has been carried out by the fixing apparatus 15. Then, the image forming process is ended.

Figure 1:
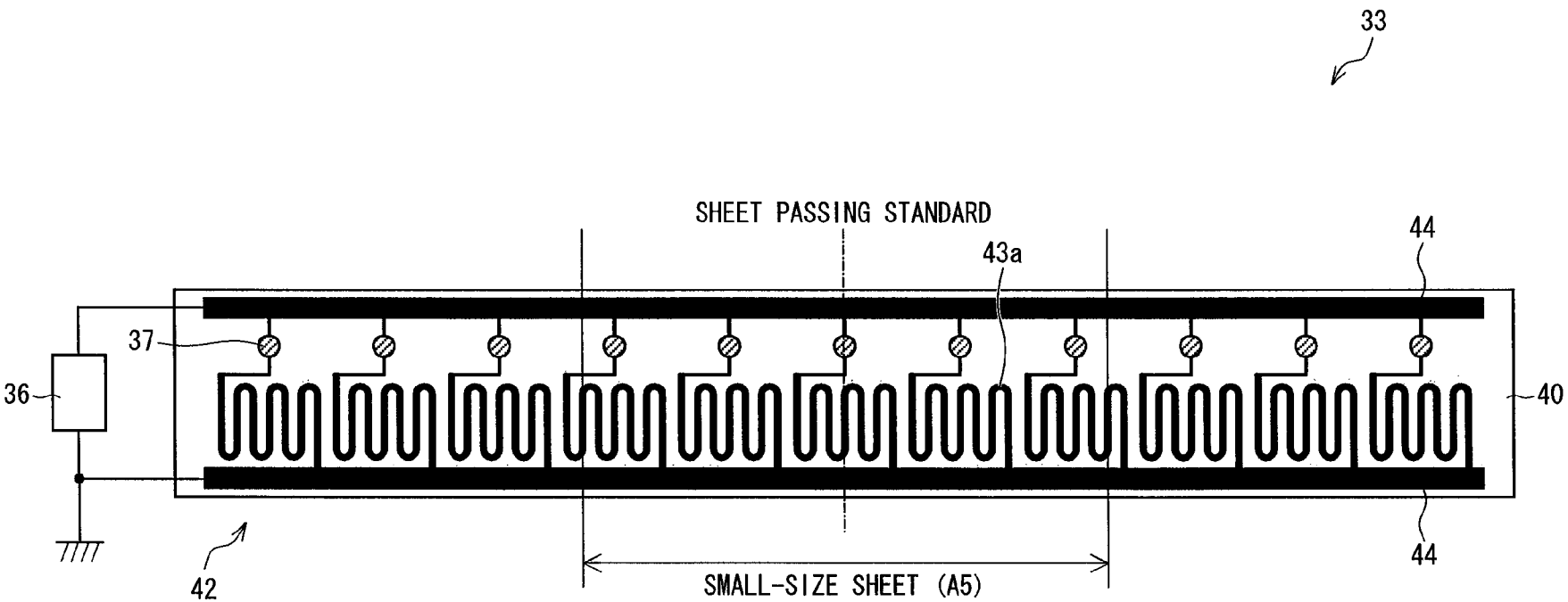
FIG. 1 is an elevation view of a planar heat-generating body formed in a heating member of a fixing unit according to an embodiment of the present invention.
Figure 3:
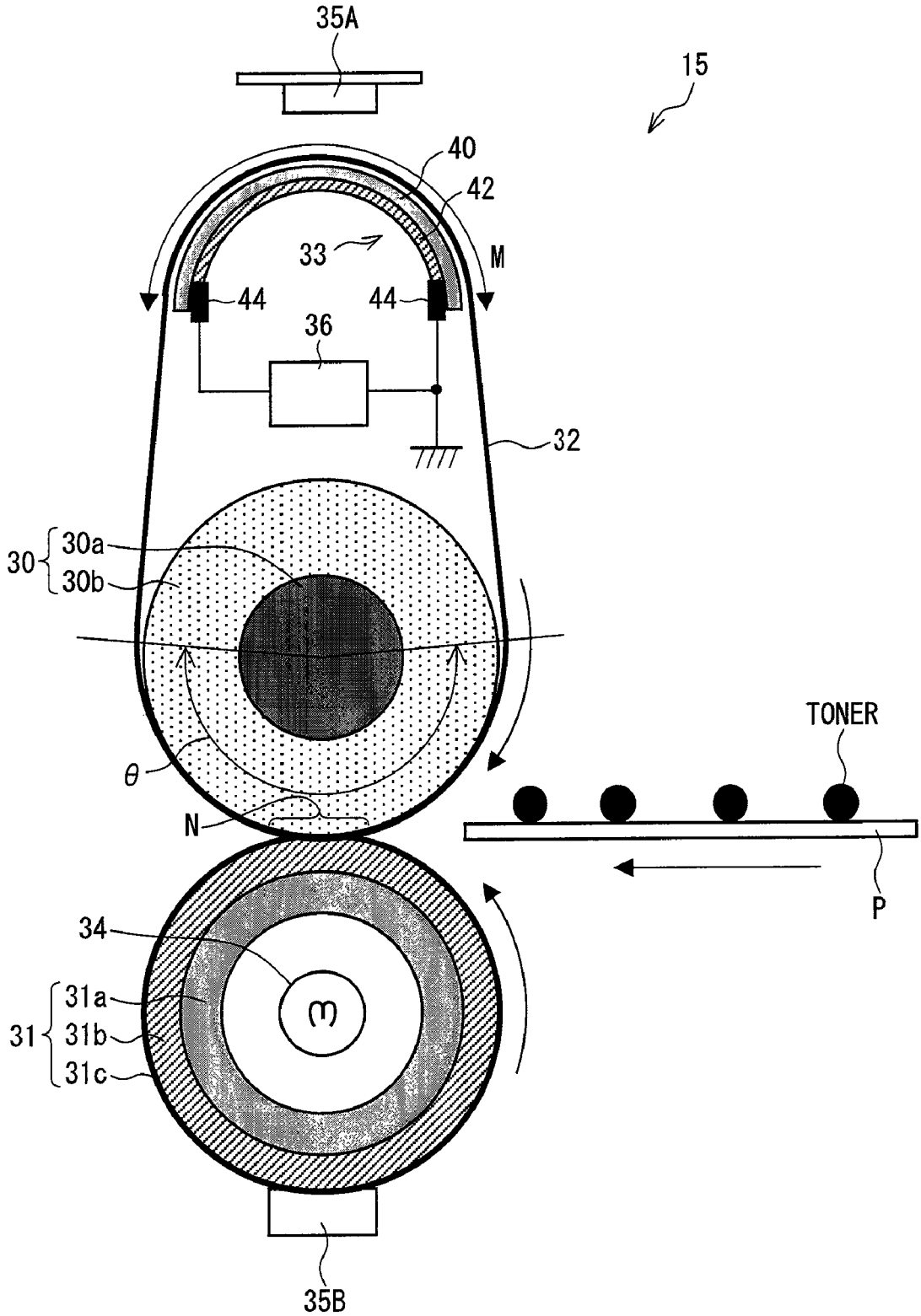
FIG. 3 is a cross-section view illustrating an arrangement of the fixing unit, when viewed in an axis direction.
Figure 4:
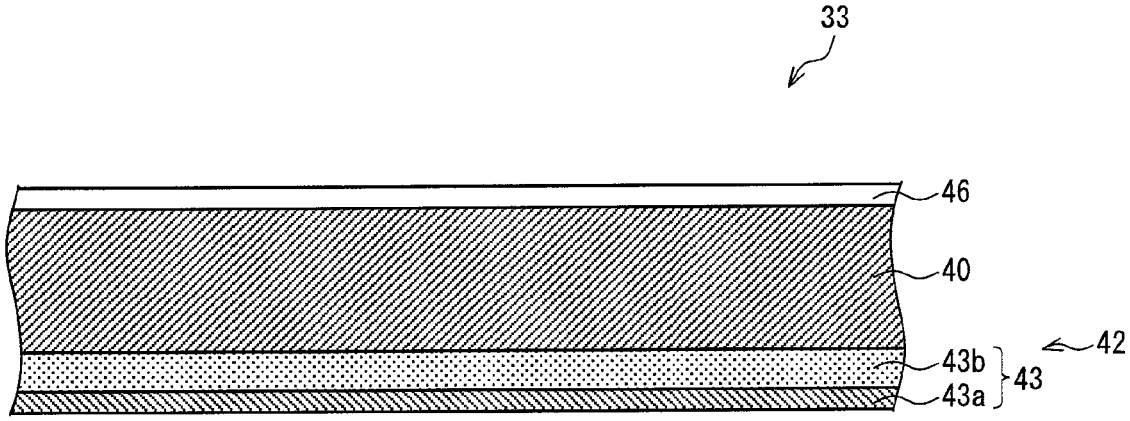
FIG. 4 is an enlarged cross-section view illustrating an arrangement of a part of the heating member of the fixing unit in which part the planar heat-generating body is formed.

Next, the following describes, with reference to FIG. 1, FIG. 3, and FIG. 4, an arrangement of the fixing apparatus 15. The fixing apparatus 15 causes an unfixed toner image formed on a surface of a recording sheet (recording material) P to be fixed on the recording sheet P by using heat and pressure. The unfixed toner image is formed by, for example, developer (toner) such as nonmagnetic single-component developer (nonmagnetic toner), nonmagnetic two-component developer (nonmagnetic toner and carrier), and magnetic developer (magnetic toner).

As illustrated in FIG. 3, the fixing apparatus 15 includes: the fixing roller (fixing member) 30; the pressure roller (pressure member) 31; a fixing belt 32 which is endless; a heating member 33 by which the fixing belt 32 is suspended and heated; a heater lamp 34 as a heat source for heating the pressure roller 31; and thermistors 35A and 35B as temperature sensors constituting temperature detecting means for detecting temperatures of the fixing belt 32 and the pressure roller 31, respectively.

The fixing roller 30 and the pressure roller 31 press each other at a predetermined load (for example, in the present embodiment, 216 N), thereby forming a fixing nip area N between the fixing roller 30 and the pressure roller 31, the fixing nip area N being an area where the fixing roller 30 and the pressure roller 31 get in touch with each other. In the present embodiment, a nip width (i.e., a width of the fixing nip area N, when viewed in a direction in which a recording sheet is carried) is set to 7 mm. However, the nip width is not limited to this value. The recording sheet P on which an unfixed toner image is formed is carried to the fixing nip area N, and then the recording sheet P is caused to pass through the fixing nip area N. Thereby, a toner image is heated and molten, so as to be fixed onto the recording sheet P. While the recording sheet P passes through the fixing nip area N, the fixing belt 32 gets in touch with a surface of the recording sheet P on which surface the toner image is formed, and the pressure roller 31 gets in touch with the other surface (i.e., a surface which is not the surface on which the toner image is formed) of the recording sheet P.

The fixing roller 30 forms the fixing nip area N by pressing the pressure roller 31 via the fixing belt 32. Further, rotation of the fixing roller 30 drives the fixing belt 32 due to friction resistance generated between the fixing roller 30 and an outer surface of the fixing belt 32. The fixing roller 30 may be, for example, the one having a two-layered construction in which a shaft 30*a* and an elastic layer 30*b* are formed in this order from the inside. The shaft 30*a* may be made from, for example, a metal such as iron, stainless steel, aluminum, copper, titanium, and magnesium or an alloy made from ones selected from these metals. Further, the elastic layer 30*b* may preferably be made from a heat-resistant rubber which is elastically deformable. Examples of such a rubber may encompass a silicon rubber and a fluororubber. In the present embodiment, the fixing roller 30 has a diameter of 30 mm; the shaft 30*a* is made from a hollow or solid stainless steel having a diameter of 15 mm; and the elastic layer 30*b* is made from a silicon sponge rubber having a thickness of 7.5 mm. Note that the diameter and the thickness are not limited to these values.

The pressure roller 31 may be, for example, the one having a three-layered construction in which a shaft 31*a*, an elastic layer 31*b*, and a releasing layer 31*c* are formed in this order from the inside. The shaft 31*a* may be made from, for example, a metal such as iron, stainless steel, aluminum, copper, titanium, and magnesium, or an alloy made from ones selected from these metals. Further, the elastic layer 31*b* may preferably be made from a heat-resistant rubber which is elastically deformable. Examples of such a rubber may encompass a silicon rubber and a fluororubber. Furthermore, the releasing layer 31*c* may preferably be made from a fluororesin such as PFA (tetrafluoroethylene-perfluoroalkyl vinyl ether copolymer) and PTFE (polytetrafluoroethylene). In the present embodiment, the pressure roller 31 has a diameter of 30 mm; the shaft 31*a* is made from an iron alloy (STKM) having a diameter of 24 mm and a thickness of 2 mm; the elastic layer 31*b* is made from a silicon solid rubber having a thickness of 3 mm; and the releasing layer 31*c* is made from a PFA tube having a thickness of 30 μm.

The pressure roller 31 internally includes the heater lamp 34 so that the pressure roller 31 is heated by the heater lamp 34 from the inside. Control means (not illustrated) causes a power source circuit (not illustrated) to supply electric power (i.e., distribute electricity) to the heater lamp 34. This causes the heater lamp 34 to emit light. Consequently, the heater lamp 34 emits an infrared ray. Then, an inner surface of the pressure roller 31 absorbs the infrared ray and thereby is heated. Thus, the whole of the pressure roller 31 is heated. In the present embodiment, the heater lamp 34 having a rated power of 400 W is used. The inner surface of the pressure roller 31 may be subjected to application of heat-resistant black paint having absorption characteristics suitable for a wavelength band of infrared rays, for the purpose of facilitating absorption of infrared rays emitted by the heater lamp 34.

The fixing belt 32 is heated to a predetermined temperature due to heat generated by the heating member 33. Further, when the recording sheet P on which an unfixed toner image is formed passes through the fixing nip area N, the fixing belt 32 heats the recording sheet P. In the present embodiment, the fixing belt 32 has a diameter of 50 mm. Further, in the present embodiment, the fixing belt 32 is supported by the heating member 33 and the fixing roller 30, and is wound around the fixing roller 30 at a predetermined angle θ. The angle θ indicates how much the fixing belt 32 is in contact with the fixing roller 30. The angle θ is made by two line segments extending from a rotational axis of the fixing roller 30 to two points at which the fixing belt 32 is separated from a surface of the fixing roller 30. In the present embodiment, the angle θ is set to θ=185°.

While the fixing roller 30 rotates, the fixing belt 32 rotates in conjunction with the fixing roller 30. The fixing belt 32 may be the one having a three-layered construction (not illustrated). For example, the fixing belt 32 may include (i) a hollow, cylindrical substrate made from a heat-resistant resin (e.g., a polyimide, a polyamide, and an aramid resin) or a metal material (e.g., stainless steel and nickel) made by means of rolling or electroforming, (ii) an elastic layer made from an elastomeric material (e.g., a silicon rubber), which is excellent in heat resistance and elasticity, the elastic layer being formed on a surface of the substrate, and (iii) a releasing layer made from a resin material (e.g., a fluororesin such as PFA and PTFE), which is excellent in heat resistance and a releasing property, the releasing layer being formed on a surface of the elastic layer. The elastomeric material and the releasing layer are formed on the outer surface side of the fixing belt 32. Further, in a case where the heat-resistant resin such as the polyimide is used as the substrate, it is preferable that a fluororesin is internally added thereto. This further reduces friction resistance generated between the fixing belt 32 and the heating member 33. In the present embodiment, the fixing belt 32 uses a polyimide having a thickness of 70 μm for the substrate, a silicon rubber having a thickness of 150 μm for the elastic layer, and a PFA tube having a thickness of 30 μm for the releasing layer. The releasing layer may be made solely from the PFA tube, or may be made from the PFA tube coated with PFA, PTFE, or the like.

The heating member 33 heats the fixing belt 32 to a predetermined temperature while getting in contact with the fixing belt 32. As illustrated in FIG. 3, the heating member 33 includes (i) a substrate 40 whose cross-section shape is a semicircular and (ii) a planar heat-generating body 42 formed on an inner surface (concave curved surface) of the substrate 40. In the present embodiment, the substrate 40 of the heating member 33 is made from an aluminum alloy pipe having a diameter of 28 mm and a thickness of 1 mm. Further, a width (heating nip width) M in which the heating member 33 is in contact with the fixing belt 32 is 44 mm.

As illustrated in FIG. 4, an insulator layer 43*b* and a resistive heat-generating layer (resistive heat-generating body) 43*a* are formed, as the planar heat-generating body 42, on the inner surface side of the substrate 40 of the heating member 33. Further, a coating layer 46 is formed on the outer surface side (convex surface side) of the substrate 40. In the present embodiment, a stainless steel foil having a thickness of 15 μm is used as the resistive heat-generating layer 43*a*; a polyimide having a thickness of 30 μm is used as the insulator layer 43*b*; and a PTFE coating having a thickness of 20 μm is used as the coating layer 46. As illustrated in an elevation view in FIG. 1, the resistive heat-generating layer 43*a* is divided into a plurality of heat-generating patterns (small heat-generating bodies) each of which (i) extends, in a direction (termed a short side direction) perpendicular to a longitudinal direction (a direction perpendicular to a direction in which the fixing belt 32 moves) of the heating member 33, from power supply electrodes 44 formed on longitudinal sides of the heating member 33 and (ii) folds at every predetermined width. (In the present embodiment, the number of heat-generating patterns is 11 in total.) The heat-generating patterns are connected to PTC elements 37, respectively.

The PTC element 37 is, specifically, a PTC thermistor made from a ceramic material (e.g., a barium titanate), an electrically-conductive polymer in which carbon is dispersed, or the like. Further, the PTC element 37 has such a characteristic that the PTC element 37 changes its resistance value rapidly when a temperature of the PTC element 37 increases and exceeds a certain value. The PTC element 37 used in the present embodiment increases its resistance when a temperature of the PTC element reaches 200° C. or higher. Hereinafter, the temperature at which the PTC element increases its resistance is termed a self control temperature of the PTC element. Each of the heat-generating patterns has an electric resistance of 110Ω, and a total electric resistance between the power supply electrodes 44 is 10Ω. The power supply electrodes 44 are connected to an AC power source 36. Applying an AC of 100V to the resistive heat-generating layer 43*a* causes the resistive heat-generating layer 43*a* to generate a heat energy of approximately 1000 W in total.

In short, the planar heat-generating body 42 includes (i) the resistive heat-generating layer 43*a* containing the plurality of heat-generating patterns which are electrically connected in parallel and are aligned in the direction (longitudinal direction) perpendicular to the direction in which the fixing belt 32 moves and (ii) the PTC elements 37 which are connected in series with the heat-generating patterns in power supply paths from the AC power source 36 to the heat-generating patterns, respectively, the PTC elements 37 increasing their resistance values at a predetermined temperature or higher.

Further, as illustrated in FIG. 3, the thermistors 35A and 35B are provided, as the temperature detection means, for the surfaces of the fixing belt 32 and the pressure roller 31, respectively. The thermistors 35A and 35B detect temperatures of the surfaces of the fixing belt 32 and the pressure roller 31, respectively. The thermistors 35A and 35B are provided in a substantial center, when viewed in a longitudinal direction of the fixing apparatus 15. In accordance with data of the temperatures detected by the thermistors 35A and 35B, a control circuit (not illustrated), which serves as the temperature control means, controls a power supply (energization) to the planar heat-generating body 42 and the heater lamp 34 so that the temperatures of the surfaces of the fixing belt 32 and the pressure roller 31 attains a predetermined temperature. In the present embodiment, the thermistor 35A is a non-contact type, and the thermistor 35B is a contact-type. Further, in the present embodiment, energization with respect to the planar heat-generating body 42 is controlled so that the temperature of the surface of the fixing belt 32 becomes 180° C. Hereinafter, the controlled temperature (180° C.) to which the fixing belt 32 is controlled is termed a fixing control temperature.

Next, the following describes operation of the fixing apparatus 15. When the recording sheet P on which an unfixed toner image is formed is carried to the fixing nip area N at a predetermined fixing speed and a predetermined copying speed, the fixing apparatus 15 carries out fixing by using heat and pressure. The fixing speed refers to a so-called process speed. The copying speed refers to how many sheets are copied per minute. The fixing speed and the copying speed are not particularly limited, however, the fixing speed is set to 220 mm/sec. in the present embodiment.

The fixing roller 30 is rotated by a drive motor (drive means) which is not illustrated. The fixing belt 32 and the pressure roller 31 are rotated in conjunction with the rotation of the fixing roller 30. Therefore, as illustrated in FIG. 1, rotational directions of the fixing belt 32 and the pressure roller 31 are reverse to each other. This allows the recording sheet P to pass through the fixing nip area N.

Heat generated by the planar heat-generating body 42 is transmitted to the fixing belt 32 via the substrate 40 made from an aluminum alloy. Thanks to this, unevenness in heating occurring due to the arrangement of the heat-generating patterns of the planar heat-generating body 42 is prevented by the substrate 40. In the present embodiment, an outer surface of the substrate 40 is coated with a fluororesin, and a substrate layer (made from PI) of the fixing belt 32 includes a fluororesin. This reduces a friction coefficient between the heating member 33 and the fixing belt 32, thereby allowing the heating member 33 to slide on the fixing belt 32 smoothly. Further, the substrate 40 made from the aluminum alloy improves heat transfer (heat conductivity) in a plain direction, thereby preventing unevenness in temperature occurring due to the arrangement of the heat-generating patterns.

Next, the following describes operation of the planar heat-generating body 42 of the present embodiment in detail. As described above, the heat-generating body 42 includes (i) the resistive heat-generating layer 43*a* divided into the 11 heat-generating patterns and (ii) the PTC elements 37 connected to the 11 heat-generating patterns, respectively. Further, as described above, the thermistor 35A is provided so as to face a center position of the planar heat-generating body 42, and power supply from the AC power source 36 to the planar heat-generating body 42 is controlled so that a temperature of the center position becomes 180° C. In the present embodiment, a sheet is fed on the basis of a center of the heat-generating body 42. In other words, the recording sheet P passes through the fixing apparatus 15, while a center of the recording sheet P is aligned with a certain position of the fixing belt 32 which certain position corresponds to a sheet passing standard (center) of the planar heat-generating body 42.

In a case where regular-size (in the present embodiment, A4-size) sheets (recording sheets) are fed in succession, heat transferred to the sheet is uniform in a longitudinal direction of the planar heat-generating body 42. Therefore, in this case, the planar heat-generating body 42 has a uniform temperature distribution at approximately 180° C. in its longitudinal direction.

On the other hand, in a case where small-size sheets (in the present embodiment, A5-size sheets) are fed in succession, in an area of the planar heat-generating body 42 which area corresponds to the non-sheet passing area of the fixing belt 32, there is no heat transfer to a sheet. Therefore, the temperature of the area of the planar heat-generating body 42 is increased to 180° C. or higher. However, some of the PTC elements 37 connected to the area of the resistive heat-generating layer 43*a* which area corresponds to the non-sheet passing area operate as follows (here, "the area of the resistive heat-generating layer 43*a*" is three heat-generating patterns in each side area of the resistive heat-generating layer 43*a* illustrated in FIG. 1): When the temperature of the area corresponding to the non-sheet passing area reaches 200° C., the some of the PTC elements 37 increase their resistances. This reduces current supplied to the heat-generating patterns in the area, thereby causing the heat-generating patterns in the area to stop generating heat. This stops the temperature increase in (i) the area corresponding to the non-sheet passing area and (ii) the non-sheet passing area of the fixing belt 32 before the temperatures of these areas exceed 200° C.

Note that all of the 11 heat-generating patterns are connected to the PTC elements, respectively. Thanks to this, it is even possible to deal with a case where the non-sheet passing area varies (e.g., a case where small-size sheets of different sizes such as a B5R-sheet, an A4R-sheet, and a B5-sheet are fed), because, in such the case, PTC elements in an area corresponding to a non-sheet passing area thus varied automatically function.

Next, the following describes the reason why (i) the self control temperature (here, 200° C.) of the PTC element 37 is set so as to be higher than the fixing control temperature (here, 180° C.) by 20° C. and (ii) the fixing is controlled by using the generally-used temperature sensor (thermistor 35A). Generally, the PTC characteristics are greatly different between PTC elements (approximately ±10° C.). Therefore, in a case where a fixing temperature is controlled by using the PTC characteristics, for example, the fixing temperature may vary depending on a place measured or a lot. Thus, in this case, it may be impossible to accurately control the fixing temperature.

In view of this, the self control temperature of the PTC element 37 is set so as to be higher than the fixing control temperature, and the fixing temperature is controlled by using the generally-used temperature sensor (thermistor 35A). This makes it possible to carry out temperature control accurately as in a conventional technique. Without a temperature increase preventing effect of the PTC element 37, when the small-size sheets are fed in succession, the temperature of the area corresponding to the non-sheet passing area increases to approximately 240° C. to 250° C. in the fixing apparatus 15 of the present invention. This increase results not only from the lack of the temperature increase preventing effect, but also from small heat capacities of the heating member 33 and the fixing belt 32. Considering this, setting the self control temperature of the PTC element 37 to 200° C., which is higher than the fixing control temperature, is effective against the temperature increase in the area corresponding to the non-sheet passing area, even if the PTC element 37 has an allowance of approximately ±10° C. in its PTC characteristics.

On the other hand, when power is turned on, or during so-called warm-up for activating the system which has been in an energy saving mode or a sleep mode, the fixing control temperature is once set to a temperature (in the present embodiment, 210° C.) higher than the self control temperature (200° C.) of the PTC element 37 so that warm-up operation is carried out.

Then, after the warm-up operation is completed, the fixing control temperature is controlled again so as to be changed to a temperature (here, 180° C.) lower than the self control temperature of the PTC element 37. This control is carried out because of the following reason: During the warm-up, a large amount of heat is lost sideways from side areas of the planar heat-generating body 42 (when viewed in the longitudinal direction of the planar heat-generating body 42). Consequently, the side areas of the planar heat-generating body 42 obtain a ready condition later than a center area of the planar heat-generating body 42 does, and thereby a temperature balance may be lost. Therefore, in a case where a control temperature for warm-up (warm-up completion temperature) is set to 180° C., the temperature of the side areas of the planar heat-generating body 42 is lower than 180° C. (here, 160° C.), at the time when the temperature of the center area of the planar heat-generating body 42 reaches 180° C. Starting the fixing operation with this state causes poor fixing at the side areas. In order to prevent this, during the warm-up, the fixing control temperature is set to 210° C., which is higher than the self control temperature. This causes the temperatures of all of the 11 heat-generating patterns including the heat-generating patterns of the side areas to reach 200° C., which is the self control temperature. Thus, the temperatures of all of the 11 heat-generating patterns once become uniform at 200° C. After that, changing the fixing control temperature to 180° C. decreases the temperature of the resistive heat-generating layer 43*a* to 180° C., while the whole of the resistive heat-generating layer 43*a* keeps its uniformity in temperature. This prevents the poor fixing at the side areas.

In a conventional fixing apparatus, judgment of whether or not warm-up operation has completed may be made based on judgment of whether or not a temperature detected by a temperature sensor (thermistor 35A) reaches the fixing control temperature. In the fixing apparatus 15 of the present embodiment, however, a heat-generating pattern in an area of the resistive heat-generating layer 43*a* which area faces the thermistor 35A is also connected to the PTC element 37. This prevents the temperature detected by the thermistor 35A from reaching the fixing control temperature of 210° C., thereby causing the warm-up never to be completed. In order to prevent this, in the present embodiment, it is determined that the warm-up is completed when a predetermined period of time has passed after the temperature detected by the thermistor 35A reaches the self control temperature (200° C.) of the PTC element 37. Here, in the present embodiment, the "predetermined period of time" is set to 5 seconds, which is equal to warm-up delay time. The warm-up delay time refers to time by which completion of the warm-up of the side areas is later than completion of the warm-up of the center area.

In this context, the "energy saving mode" refers such a mode that, although the heater and the like in the fixing apparatus 15 are energized, the temperature of the fixing apparatus 15 is set so as to be lower than a control temperature (of the fixing apparatus 15) for the warm-up, copying operation, copying stand-by operation, or the like, for the purpose of reducing electric power consumption. The "sleep mode" refers to such a mode that, although a CPU (not illustrated) and the like of the image forming apparatus 100 are energized, the heater and the like of the fixing apparatus 15 are not energized, for the purpose of reducing electric power consumption.

The foregoing temperature setting and the foregoing changing operation are controlled by the CPU (not illustrated) which controls the image forming apparatus 100.

Second Embodiment

Figure 5:
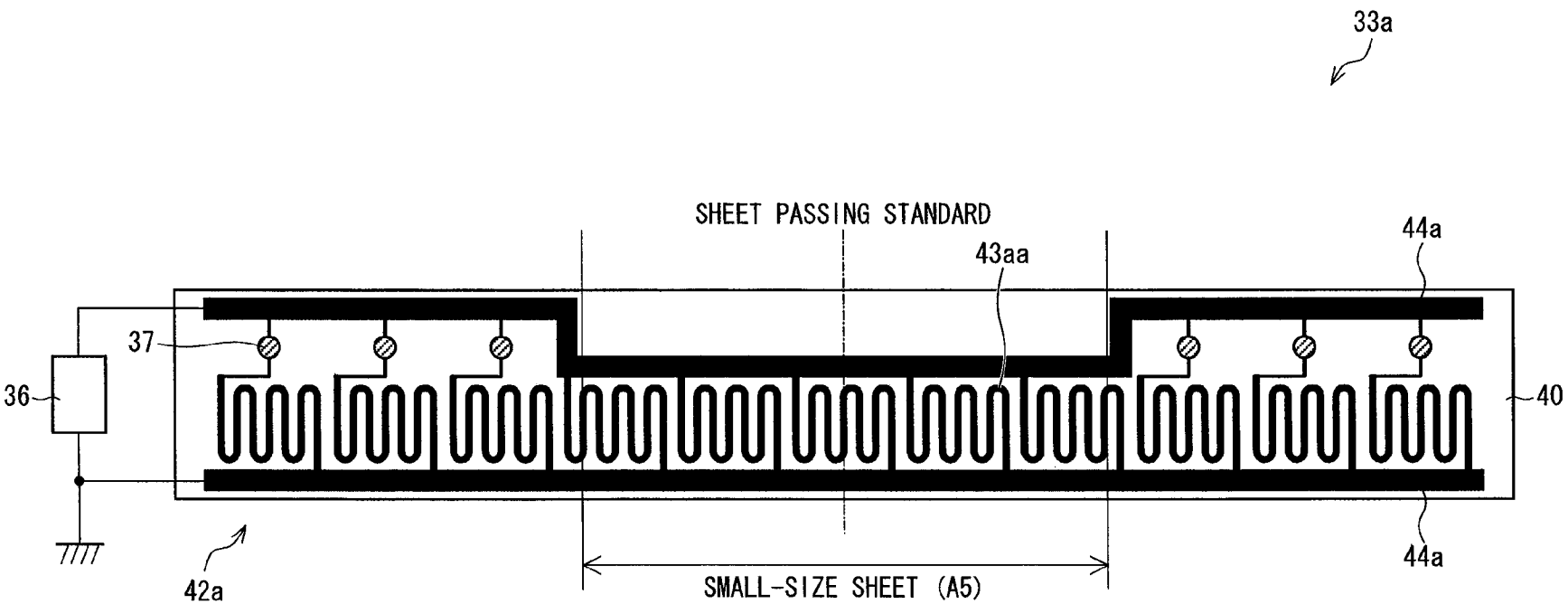
FIG. 5 is an elevation view of a planar heat-generating body according to another embodiment of the present invention.

Next, the following describes, with reference to FIG. 5, a fixing apparatus according to another embodiment of the present invention. For convenience of explanation, members having the same functions as those explained in First Embodiment are given the same signs as First Embodiment, and explanations thereof are omitted here.

An arrangement of a planar heat-generating body in the fixing apparatus of the present embodiment is different from that of First Embodiment. As illustrated in FIG. 5, a planar heat-generating body 42*a* of a heating member 33*a* in the fixing apparatus of Second Embodiment has a wiring pattern different from that of the planar heat-generating body 42 described in First Embodiment. Specifically, in the planar heat-generating body 42*a*, a resistive heat-generating layer 43*aa* is divided into a plurality of heat-generating patterns. Among the plurality of the heat-generating patterns, some heat-generating patterns which are provided in longitudinal side areas (i.e., side areas when viewed in a widthwise direction of a fixing belt) are connected to PTC elements, respectively, and the other heat-generating patterns in an inner area are not connected to the PTC elements but are directly connected to power supply electrodes 44*a*. In the present embodiment, the number of the heat-generating patterns is 11. Further, three heat-generating patterns in each of the longitudinal side areas of the planar heat-generating body 42*a* i.e., a total of six heat-generating patterns are connected to PTC elements 37, respectively. On the other hand, remaining five heat-generating patterns in the inner area are not connected to the PTC elements, but are directly connected to the power supply electrodes 44*a*.

In the present embodiment, sheet feeding is carried out on the basis of a center of the planar heat-generating body 42*a*. In other words, a sheet passes through the fixing apparatus, while a center of the sheet is aligned with a position of the fixing belt 32 which position corresponds to a sheet passing standard (center) of the planar heat-generating body 42*a*. The five heat-generating patterns in the inner area of the planar heat-generating body 42*a* deal with a sheet (here, an A5-sheet) having a smallest width among small-size sheets.

Further, as in First Embodiment, a thermistor 35A is provided so as to face a center position of the planar heat-generating body 42*a*, and power supply from an AC power source 36 to the planar heat-generating body 42*a* is controlled so that a temperature of the center position becomes 180° C.

In a case where regular-size sheets (here, A4-size sheets) are fed in succession, heat transferred to the sheet is uniform in a longitudinal direction of the planar heat-generating body 42*a*. Therefore, in this case, the planar heat-generating body 42*a* has a uniform temperature distribution at approximately 180° C. in its longitudinal direction.

On the other hand, in a case where small-size sheets (here, A5-size sheets) are fed in succession, in an area of the planar heat-generating body 42*a* which area corresponds to a non-sheet passing area of the fixing belt 32, there is no heat transfer to a sheet. Therefore, a temperature of the area of the planar heat-generating body 42*a* increases to 180° C. or higher. However, some of the PTC elements 37 connected to the heat-generating pattern in the area corresponding to the non-sheet passing area operate as follows: When the temperature of the area corresponding to the non-sheet passing area reaches 200° C., the some of the PTC elements 37 increase their resistances. This reduces current supplied to the heat-generating patterns in the area, thereby causing the heat-generating patterns in the area to stop generating heat. This stops the temperature increase in the area of the planar heat-generating body 42*a* before the temperature of the area exceeds 200° C.

Each of the side areas of the resistive heat-generating layer 43*aa* which side areas correspond to the non-sheet passing areas is divided into three heat-generating patterns. Therefore, it is even possible to deal with a case where the non-sheet passing area varies (e.g., a case where a sheet of a size larger than A5, such as a B5R-sheet, an A4R-sheet, and a B5-sheet, is fed).

Further, in the present embodiment, the five heat-generating patterns in the inner area, which is not an area corresponding to the non-sheet passing area, are not connected to the PTC element 37. This makes it possible to efficiently prevent a temperature increase in the non-sheet passing area, without increasing the number of the PTC elements 37 needlessly.

Third Embodiment

Figure 6:
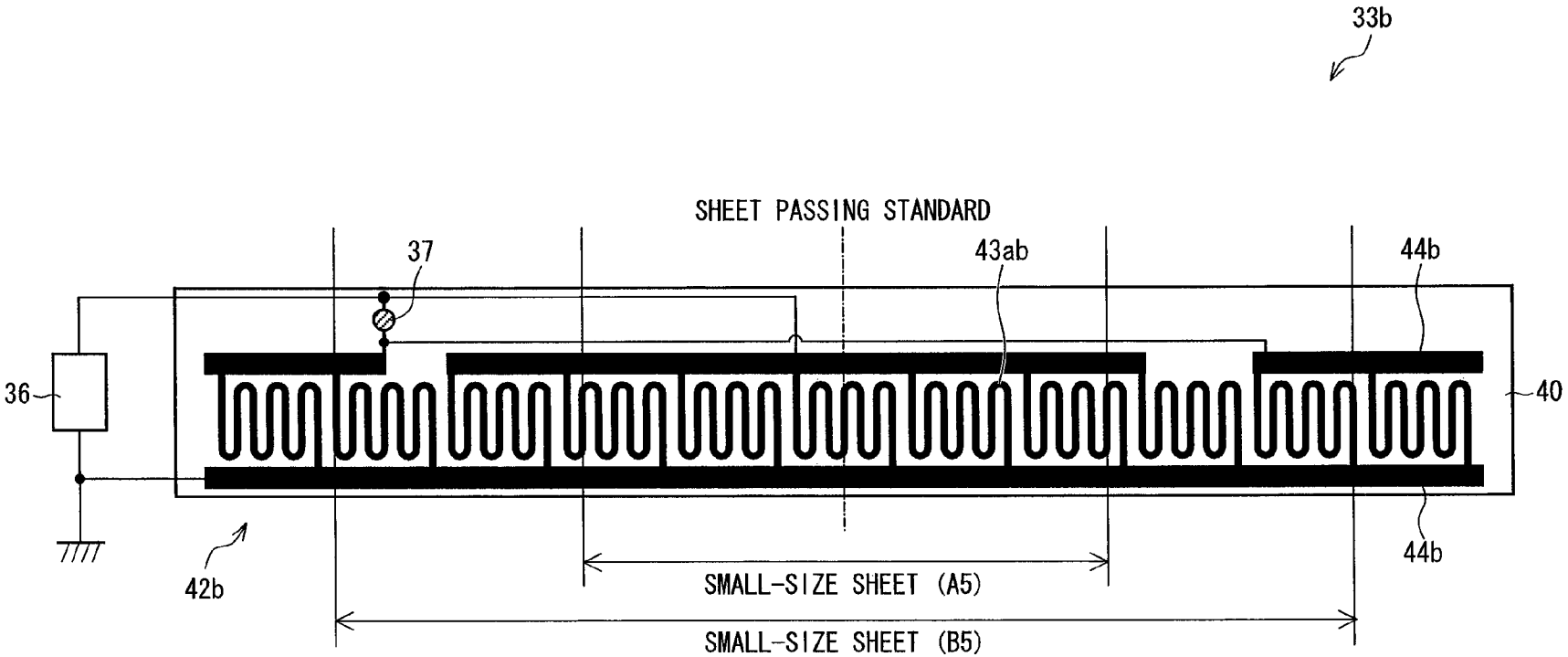
FIG. 6 is an elevation view of a planar heat-generating body according to further another embodiment of the present invention.

Next, the following describes, with reference to FIG. 6, a fixing apparatus according to further another embodiment of the present invention. For convenience of explanation, members having the same functions as those explained in First Embodiment are given the same signs as First Embodiment, and explanations thereof are omitted here.

An arrangement of a planar heat-generating body in the fixing apparatus of the present embodiment is different from that of First Embodiment. As illustrated in FIG. 6, a planar heat-generating body 42*b* of a heating member 33*b* in the fixing apparatus of Third Embodiment has a wiring pattern different from that of the planar heat-generating body 42 described in First Embodiment. Specifically, in the planar heat-generating body 42*b*, a resistive heat-generating layer 43*ab* is divided into a plurality of heat-generating patterns. Among the plurality of the heat-generating patterns, some heat-generating patterns which are provided in longitudinal side areas (i.e., side areas when viewed in a widthwise direction of the fixing belt 32) are connected to one PTC element in common, and the other heat-generating patterns in an inner area are not connected to the PTC element but are directly connected to power supply electrodes 44*b*. In the present embodiment, the number of the heat-generating patterns is 11. Further, two heat-generating patterns in each of the longitudinal side areas of the planar heat-generating body 42*b* i.e., a total of four heat-generating patterns are connected to one PTC element 37 in common. On the other hand, remaining seven heat-generating patterns in the inner area are not connected to the PTC element, but are directly connected to the power supply electrodes 44*b*.

In the present embodiment, sheet feeding is carried out on the basis of a center of the planar heat-generating body 42*b*. In other words, a sheet passes through the fixing apparatus, while a center of the sheet is aligned with a position of the fixing belt 32 which position corresponds to a sheet passing standard (center) of the planar heat-generating body 42*b*. The seven heat-generating patterns provided in the inner area of the planar heat-generating body 42*b* deal with a sheet (here, an A5-sheet) having a smallest width among small-size sheets.

Further, as in First Embodiment, a thermistor 35A is provided so as to face a center position of the planar heat-generating body 42*b*, and power supply from an AC power source 36 to the planar heat-generating body 42*b* is controlled so that a temperature of the center position becomes 180° C.

In a case where regular-size sheets (here, A4-size sheets) are fed in succession, heat transferred to the sheet is uniform in a longitudinal direction of the planar heat-generating body 42*b*. Therefore, in this case, the planar heat-generating body 42*b* has a uniform temperature distribution at approximately 180° C. in its longitudinal direction.

On the other hand, in a case where small-size sheets (here, A5-size sheets) are fed in succession, in an area of the planar heat-generating body 42*b* which area corresponds to a non-sheet passing area of the fixing belt 32, there is no heat transfer to a sheet. Therefore, the temperature of the area of the planar heat-generating body 42*b* increases to 180° C. or higher. However, some of the PTC elements 37 connected to the heat-generating pattern in the area corresponding to the non-sheet passing area operate as follows: When the temperature of the area corresponding to the non-sheet passing area reaches 200° C., the some of the PTC elements 37 increase their resistances. This reduces current supplied to the heat-generating patterns in the area, thereby causing the heat-generating patterns to stop generating heat. This stops the temperature increase in the area of the planar heat-generating body 42*b* before the temperature of the area exceeds 200° C.

In fixing, in a case where a sheet is fed on the basis of a center, a temperature is generally distributed symmetrically in a longitudinal direction. Therefore, connecting heat-generating patterns to one PTC element 37 in common does not impair the function, as long as the heat-generating patterns are provided so as to be point-symmetric. This makes it possible to reduce the number of the PTC elements to be used.

In a case where all heat-generating patterns provided so as to be point-symmetric in an area corresponding to a non-sheet passing area are connected to the PTC element in common by using respective wires, a wiring pattern thereof becomes very complicated. In order to prevent this, the present embodiment is arranged such that the four heat-generating patterns (two heat-generating patterns in one side area×2) in the non-sheet passing areas are connected to the one PTC element by using a shared wire. This reduces the number of the PTC elements 37 to be used to one, which is a minimum number. Although a capacity to deal with various sizes of sheets is decreased with this arrangement, it does not become a problem in practice.

Fourth Embodiment

Figure 7:
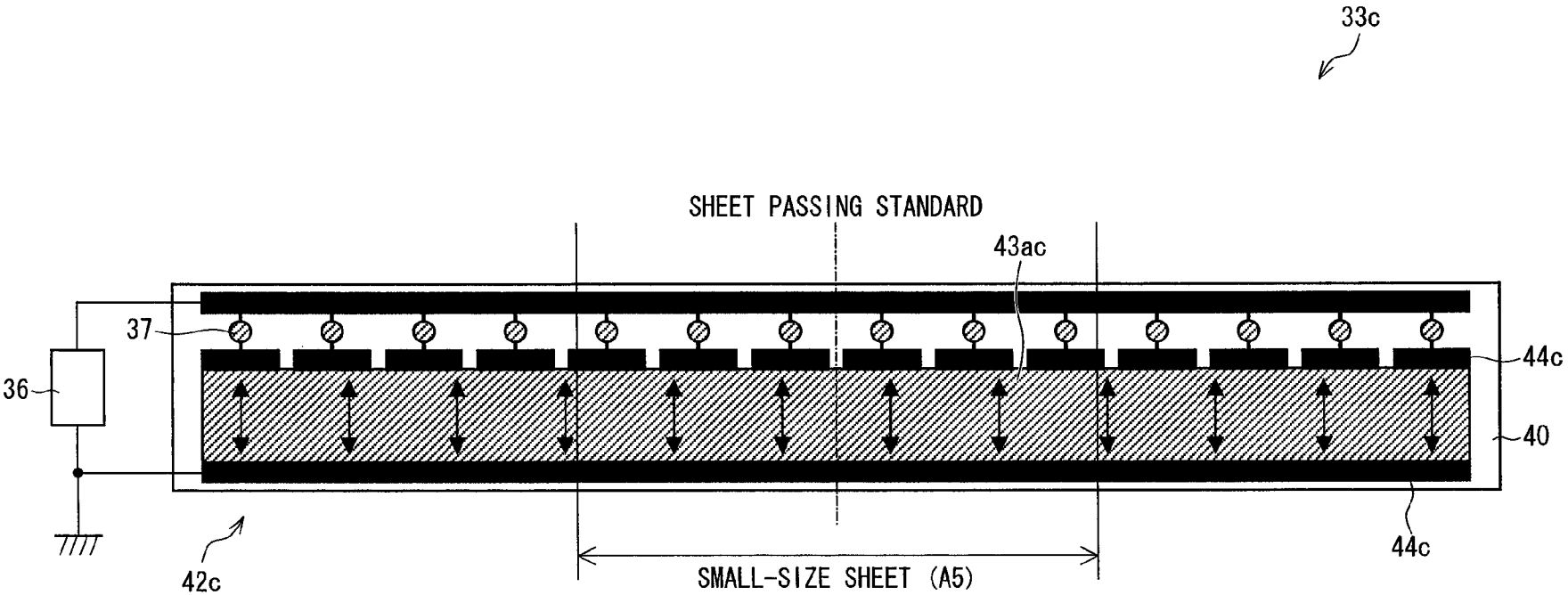
FIG. 7 is an elevation view of a planar heat-generating body according to still further another embodiment of the present invention.

Next, the following describes, with reference to FIG. 7, a fixing apparatus according to still further another embodiment of the present invention. For convenience of explanation, members having the same functions as those explained in First Embodiment are given the same signs as First Embodiment, and explanations thereof are omitted here.

An arrangement of a planar heat-generating body in the fixing apparatus of the present embodiment is different from that described in First Embodiment. As illustrated in FIG. 7, a planar heat-generating body 42*c* of a heating member 33*c* in the fixing apparatus of Fourth Embodiment is different the planar heat-generating body 42 described in First Embodiment. Specifically, in the planar heat-generating body 42*c*, a resistive heat-generating layer 43*ac* is one body, and a power supply electrode 44*c* which is connected to the resistive heat-generating layer 43*ac* is divided into 11 small electrodes. Further, the small electrodes are connected to PTC elements 37, respectively.

A total electric resistance between the power supply electrodes 44*c* is 10Ω. The power supply electrodes 44*c* which are not connected to the resistive heat-generating layer 43*ac* are connected to an AC power source 36. Applying an AC of 100V to the resistive heat-generating layer 43*ac* causes the resistive heat-generating layer 43*ac* to generate a heat energy of approximately 1000 W in total.

In the present embodiment, the planar heat-generating body 42*c* includes (i) the resistive heat-generating layer 43*ac* extending in a direction (longitudinal direction) perpendicular to a direction in which the fixing belt 32 moves, (ii) the plurality of small electrodes, provided on one side surface of the resistive heat-generating layer 43*ac* in a direction in which the resistive heat-generating layer 43*ac* extends, which are electrically separated from each other and cause current to flow through the resistive heat-generating layer 43*ac* in parallel to the direction in which the fixing belt moves, (iii) an electrode, provided on the other side surface of the resistive heat-generating layer 43*ac*, which is grounded, and (iv) the PTC element 37 and corresponding one of the plurality of small electrodes being provided so as to be connected in series with the power source, the PTC element 37 having a resistance value increasing at a predetermined temperature or higher.

Although the resistive heat-generating layer 43*ac* is one body, the power supply electrode 44*c* for the resistive heat-generating layer 43*ac* is divided into the small electrodes, and the small electrodes are connected to the PTC elements 37, respectively. Therefore, as indicated by the arrows in FIG. 7, current flows through the resistive heat-generating layer 43*ac* in parallel to a short side direction of the resistive heat-generating layer 43*a*. As a result, it is possible to attain substantially the same effect as obtained by the heating member 33 of First Embodiment. This makes it possible to simplify a pattern of the resistive heat-generating layer 43*ac*, compared with that of First Embodiment, and this eliminates gaps made by the division as seen in First Embodiment. This prevents effects given by unevenness in temperature occurred due to the gaps.

Fifth Embodiment

Figure 8:
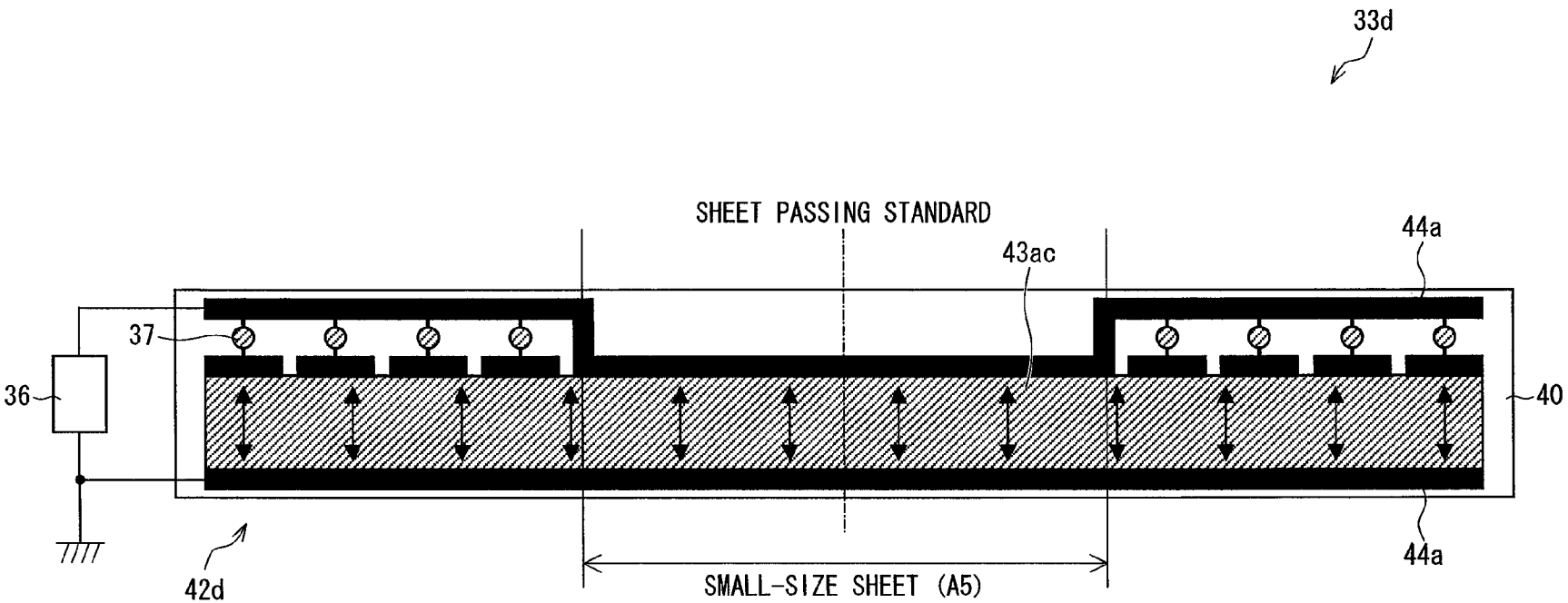
FIG. 8 is an elevation view of a planar heat-generating body according to yet another embodiment of the present invention.

A planar heat-generating body of a heating member used in a fixing apparatus according to yet another embodiment of the present invention is illustrated in FIG. 8. A planar heat-generating body 42*d* of a heating member 33*d* according to the present embodiment is realized by a combination of (i) the arrangement of the PTC elements in Second Embodiment described above and (ii) the resistive heat-generating layer 43*ac* of Fourth Embodiment described above. Therefore, explanations of the planar heat-generating body 42*d* are omitted here.

Sixth Embodiment

Figure 9:
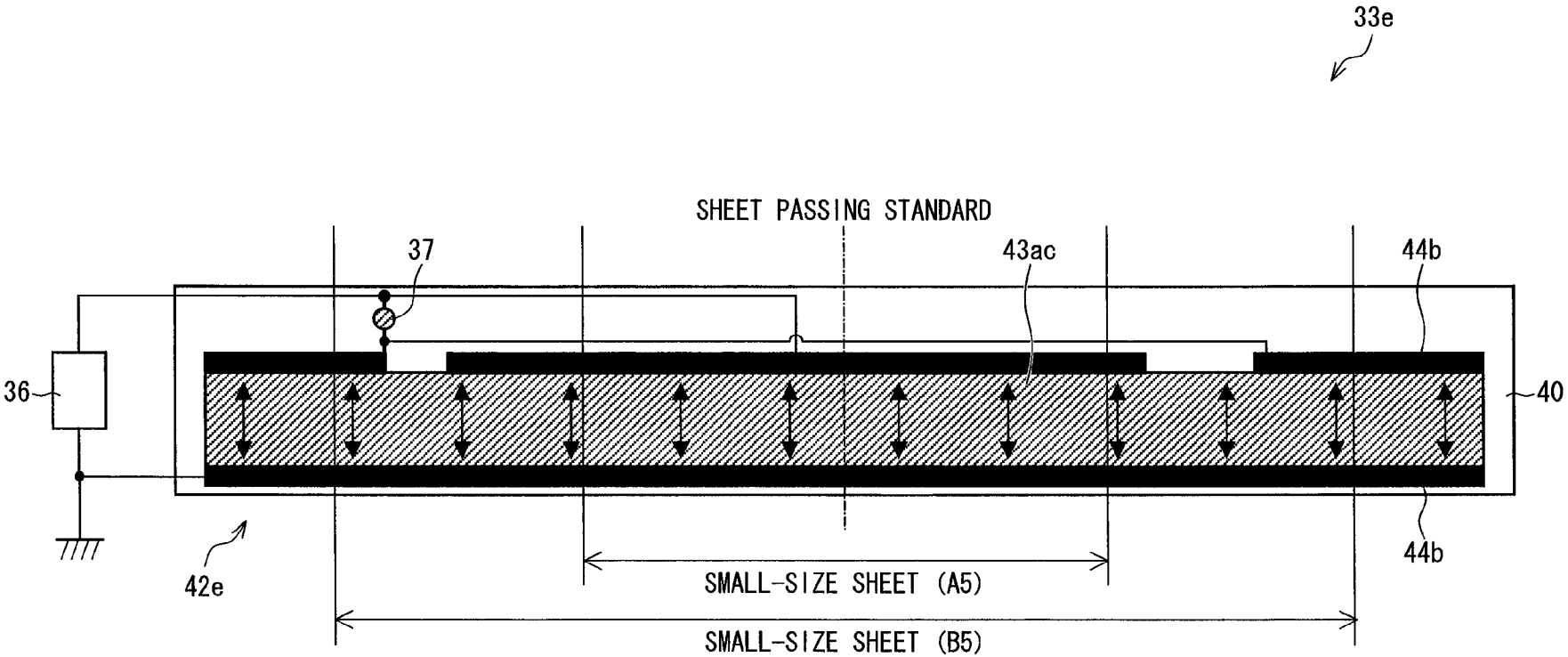
FIG. 9 is an elevation view of a planar heat-generating body according to still yet another embodiment of the present invention.

A planar heat-generating body of a heating member used in a fixing apparatus according to still yet another embodiment of the present invention is illustrated in FIG. 9. A planar heat-generating body 42*e* of a heating member 33*e* according to the present embodiment is realized by a combination of (i) the PTC element 37 which is in common connected to the heat-generating patterns in Third Embodiment described above and (ii) the resistive heat-generating layer 43*ac* of Fourth Embodiment described above. Therefore, explanations of the planar heat-generating body 42*e* are omitted here.

Described above is the embodiments and the examples illustrating a case where a fixing apparatus of the present invention is applied to a planar heat-generating belt type fixing apparatus in which (a) a fixing belt directly heats a toner image on a sheet but (b) a heating member is not provided at a fixing nip area. However, the present invention is not limited to the planar heat-generating belt type fixing apparatus. Needles to say, the present invention may also be applied to, for example, (i) a heating member (planar heat-generating body) of a film type fixing apparatus as illustrated in FIG. 10 in which (a) a fixing film directly heats a toner image on a sheet and (b) a heating member is provided at a fixing nip area, and (ii) a belt heating member of an external belt heat type fixing apparatus as illustrated in FIG. 11 in which (a) a heating belt once heats a surface of a fixing roller and (b) the fixing roller thus heated by the heating belt heats a toner image on a sheet.

Figure 10:
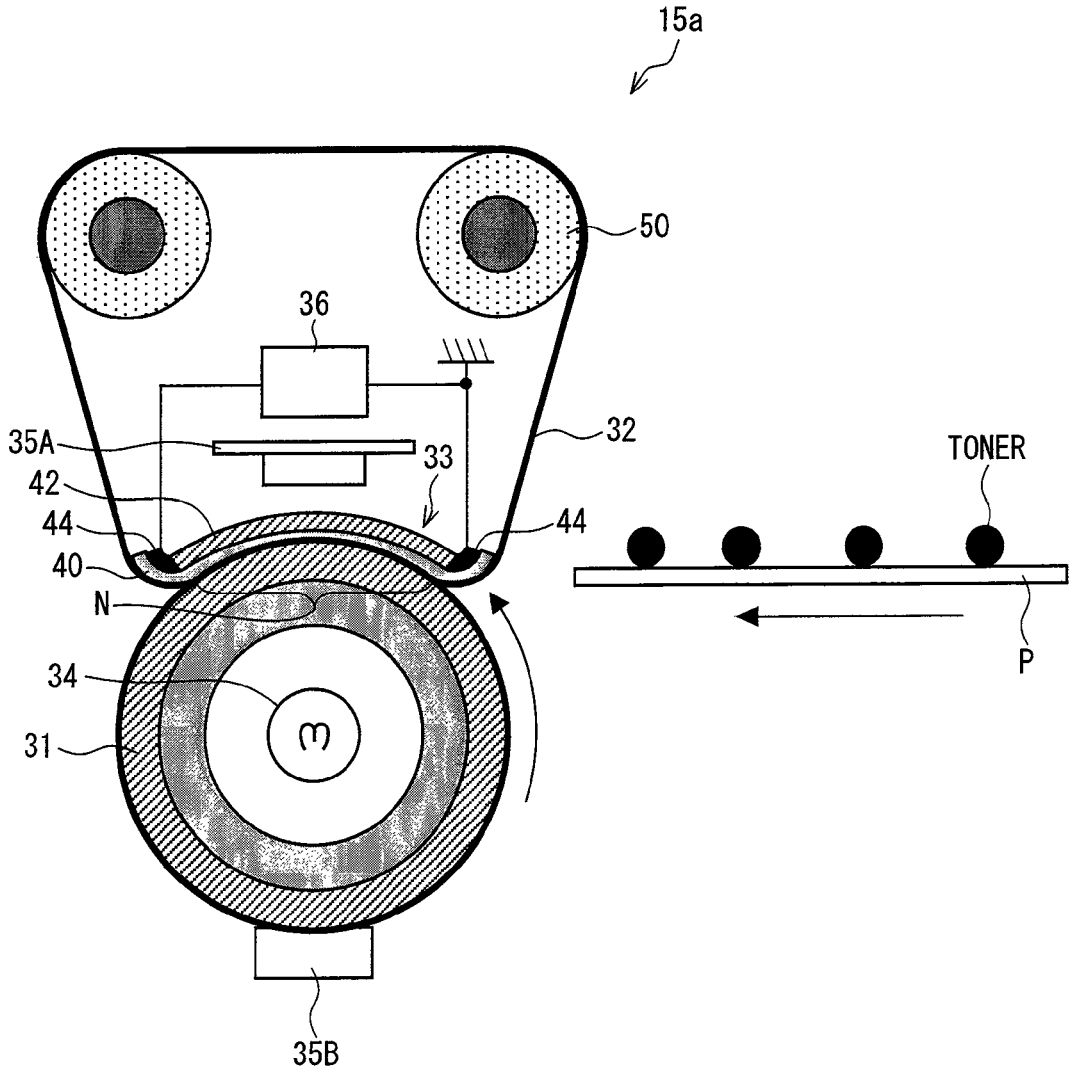
FIG. 10 is a cross-section view illustrating an arrangement of a fixing unit according to additional embodiment of the present invention, when viewed in an axial direction.

In a fixing apparatus 15*a* illustrated in FIG. 10, a fixing nip area N is formed by a pressure roller 31 and a heating member 33 via a fixing belt 32. In the heating member 33, a planar heat-generating body 42 is provided on a convex surface of a substrate 40 which is curved, and a concave surface of the substrate 40 abuts the pressure roller 31 via the fixing belt 32. In other words, in the fixing apparatus 15*a*, the fixing nip also serves as a heating nip. Further, the fixing belt 32 is set around two supporting rollers 50 and the substrate 40 of the heating member. No fixing roller is provided in the fixing apparatus 15*a*. The fixing belt 32 rotates in conjunction with rotation of the pressure roller 31.

Figure 11:
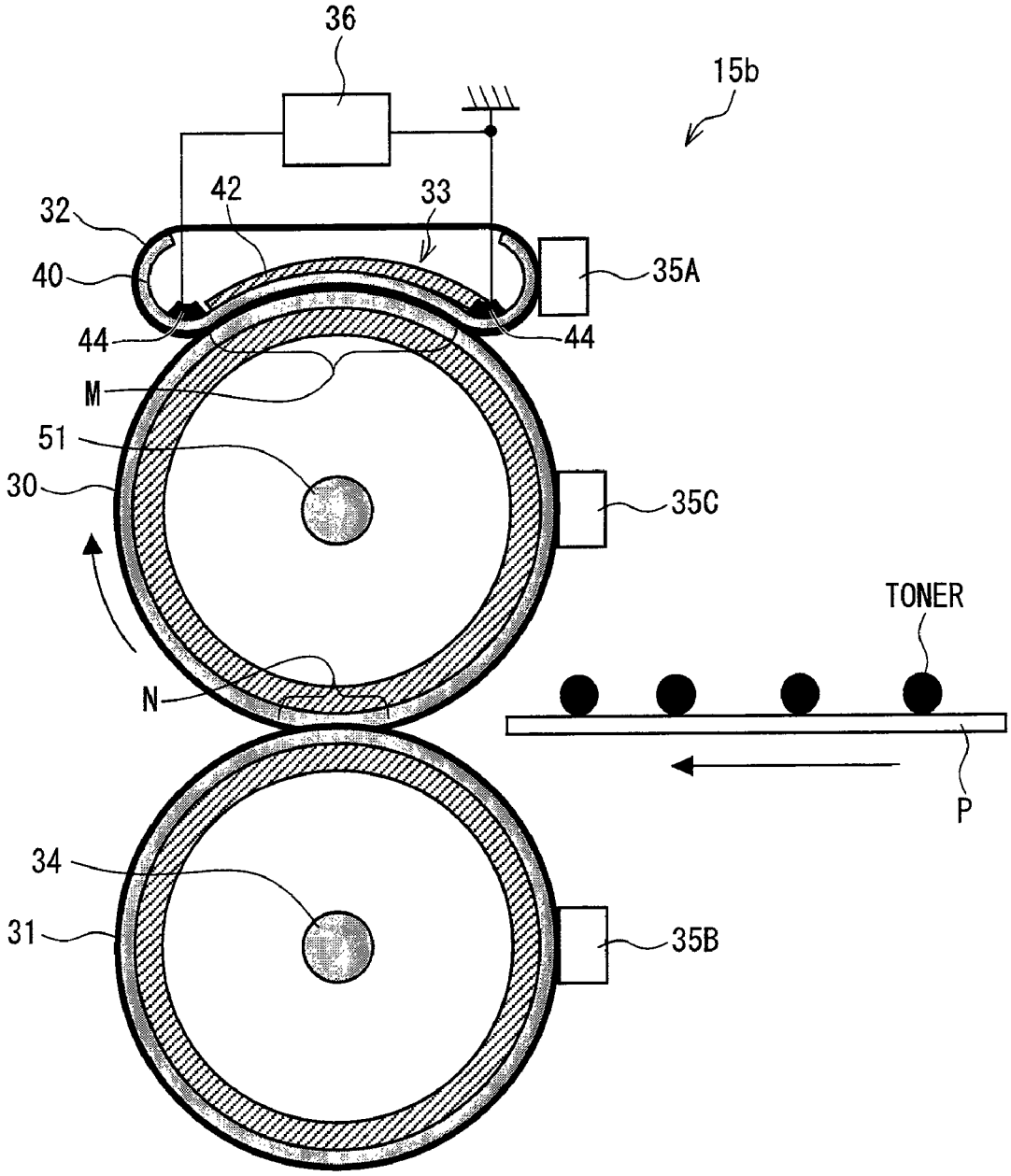
FIG. 11 is a cross-section view illustrating an arrangement of a fixing unit according to further additional embodiment of the present invention, when viewed in an axial direction.

In a fixing apparatus 15*b* illustrated in FIG. 11, a heating nip area M is formed by a heating member 33 and a fixing roller 30 via a fixing belt 32. In the heating member 33, a planar heat-generating body 42 is provided on a convex surface of a substrate 40 which is curved, and a concave surface of the substrate 40 abuts the fixing roller 30 via the fixing belt 32. The fixing belt 32 is set around the substrate 40 of the heating member 33.

As described above, a fixing apparatus according to the present invention includes: a fixing member which is rotatable; a heating member which is curved and includes a planar heat-generating body; and a fixing belt which is endless and moves while getting in contact with the fixing member and the heating member, the fixing member and the heating member being arranged such that a concave curved surface of the heating member faces the fixing member, the planar heat-generating body, including: a resistive heat-generating body containing a plurality of small heat-generating bodies which are electrically connected in parallel and are aligned in a direction perpendicular to a direction in which the fixing belt moves; and (i) positive temperature coefficient elements and whole of or some of the plurality of small heat-generating bodies being provided, respectively, so as to be connected in series with a power source or (ii) a single positive temperature coefficient element and some of the plurality of small heat-generating bodies being provided so as to be connected in series with the power source, in an area corresponding to a non-sheet passing area of the fixing belt, the non-sheet passing area being an area where a smallest-size sheet does not pass, the smallest-size sheet being smallest among sheets that the fixing apparatus deals with, the positive temperature coefficient element(s) having a resistance value increasing at a predetermined temperature or higher.

Further, in addition to the foregoing arrangement, the fixing apparatus according to the present invention may be arranged such that: the positive temperature coefficient elements and part of the plurality of small heat-generating bodies are provided, respectively, so as to be connected in series with the power source.

It is not necessary to provide the PTC elements to all of the plurality of the small heat-generating bodies, respectively. For example, it is not necessary to provide the PTC element to a small heat-generating body which is provided in a center area of the planar heat-generating body, for example, a small heat-generating body which is provided in an area facing an area where a temperature sensor such as a thermistor is provided. Thus, by connecting the PTC element only to a necessary part, it is possible to reduce a cost.

Furthermore, in addition to the foregoing arrangement, the fixing apparatus according to the present invention may be arranged such that: the single positive temperature coefficient element and at least one pair of the plurality of small heat-generating bodies are provided so as to be connected in series with the power source, said at least one pair being provided so as to be point-symmetric with respect to a center of alignment of the plurality of small heat-generating bodies.

In fixing operation, a temperature is generally distributed symmetrically in a direction (a longitudinal direction of the planar heat-generating body) perpendicular to the direction in which the fixing belt moves. Therefore, connecting the pair of small heat-generating bodies to the one PTC element does not impair the function, as long as the pair of small heat-generating bodies is provided so as to be point-symmetric with respect to the center of the alignment of the small heat-generating bodies. This makes it possible to reduce the number of PTC elements to be used, thereby reducing a cost.

Further, as described above, a fixing apparatus according to the present invention includes: a fixing member which is rotatable; a heating member which is curved and includes a planar heat-generating body; and a fixing belt which is endless and moves while getting in contact with the fixing member and the heating member, the fixing member and the heating member being arranged such that a concave curved surface of the heating member faces the fixing member, the planar heat-generating body, including: a resistive heat-generating body which extends in a direction perpendicular to a direction in which the fixing belt moves; a plurality of small electrodes, provided on one side surface of the resistive heat-generating body in a direction in which the resistive heat-generating body extends, which are electrically separated from each other and cause current to flow through the resistive heat-generating body in a direction parallel to the direction in which the fixing belt moves; an electrode, provided on the other side surface of the resistive heat-generating body, which is grounded; and (i) positive temperature coefficient elements and whole of or some of the plurality of small electrodes being provided, respectively, so as to be connected in series with a power source or (ii) a single positive temperature coefficient element and some of the plurality of small electrodes being provided so as to be connected in series with the power source, in an area corresponding to a non-sheet passing area of the fixing belt, the non-sheet passing area being an area where a smallest-size sheet does not pass, the smallest-size sheet being smallest among sheets that the fixing apparatus deals with, the positive temperature coefficient element(s) having a resistance value increasing at a predetermined temperature or higher.

Furthermore, in addition to the foregoing arrangement, the fixing apparatus according to the present invention may be arranged such that: the positive temperature coefficient elements and part of the plurality of small electrodes are provided, respectively, so as to be connected in series with the power source.

It is not necessary to provide the PTC elements to all of the small electrodes, respectively. For example, it is not necessary to provide the PTC element to a small electrode which is provided in the center area of the planar heat-generating body, for example, a small electrode which is provided in an area facing an area where the temperature sensor such as the thermistor is provided. Thus, by connecting the PTC element only to a necessary part, it is possible to reduce a cost.

Moreover, in addition to the foregoing arrangement, the fixing apparatus according to the present invention may be arranged such that: the single positive temperature coefficient element and at least one pair of the plurality of small electrodes are provided so as to be connected in series with the power source, said at least one pair being provided so as to be point-symmetric with respect to a center of alignment of the plurality of small electrodes.

In the fixing operation, a temperature is generally distributed symmetrically in the direction (the longitudinal direction of the planar heat-generating body) perpendicular to the direction in which the fixing belt moves. Therefore, connecting the pair of electrodes to the one PTC element does not impair the function, as long as the pair of small electrodes is provided so as to be point-symmetric with respect to the center of the alignment of the small electrodes. This makes it possible to reduce the number of PTC elements to be used, thereby reducing a cost.

Further, in the fixing apparatus according to the present invention, in addition to the foregoing arrangement, it is preferable that the following relationship is satisfied: $T2<T1$, where T1 is a self control temperature and T2 is a fixing control temperature, the self control temperature being the predetermined temperature at which the resistance value of the positive temperature coefficient element(s) increases, the fixing control temperature being a temperature of the fixing belt at which temperature fixing is carried out.

PTC characteristics are greatly different between PTC elements. Therefore, in a case where a fixing temperature is controlled by using the PTC element, for example, the fixing temperature may vary depending on a place measured or a lot. Thus, in this case, it may be impossible to accurately control the fixing temperature. In view of this, the self control temperature T1 of the PTC element is set so as to be higher than the fixing control temperature T2, and the fixing temperature is controlled by using a generally-used temperature sensor. This makes it possible to carry out temperature control accurately as in a conventional fixing apparatus. The temperature control for dealing with the temperature increase in the non-sheet passing area occurred when the small-size sheets are fed is effective even if the temperature control is carried out roughly to some extent. Therefore, it is possible to prevent the temperature increase by using the PTC element.

An image forming apparatus according to the present invention includes any one of the foregoing fixing apparatuses according to the present invention. Therefore, with a simple arrangement, it is possible to prevent the temperature increase in the non-sheet passing area and provide a high-quality image.

Further, in addition to the foregoing arrangement, the image forming apparatus according to the present invention may further include temperature changing means for changing T2 so that (i) T2 is higher than T1 during warm-up of the image forming apparatus and (ii) T2 is lower than T1 after the warm-up is completed, T1 being a self control temperature which is the predetermined temperature at which the resistance value of the positive temperature coefficient element(s) increases, T2 being a fixing control temperature which is a temperature of the fixing belt at which temperature fixing is carried out.

During warm-up, a large amount of heat is lost sideways from the side areas of the planar heat-generating body which side areas are along the direction (the longitudinal direction) perpendicular to the direction in which the fixing belt moves. Consequently, the side areas of the planar heat-generating body obtain a ready condition later than a center area of the planar heat-generating body does, and thereby a temperature balance is apt to be lost. In order to prevent this, during warm-up operation, the following relationship is once satisfied: T2>T1. This causes the side areas and the center area to become the temperature of T1, thereby allowing the planar heat-generating body to have a uniform temperature distribution in its longitudinal direction.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims. Further, the present invention encompasses a value range other than the value ranges described above, as long as the value range is a reasonable range that is not contradictory to the purpose of the present invention.

Note that the present invention is applicable to (i) a fixing apparatus included in an electrophotographic image forming apparatus such as a printer, a copying machine, a facsimile, and a Multi Function Printer (MFP) and (ii) the image forming apparatus.

The invention claimed is:

1. A fixing apparatus, comprising:

a fixing member which is rotatable;

a heating member which is curved and includes a planar heat-generating body; and a fixing belt which is endless and moves while getting in contact with the fixing member and the heating member, the fixing member and the heating member being arranged such that a concave curved surface of the heating member faces the fixing member, the planar heat-generating body, including:

a resistive heat-generating body containing a plurality of small heat-generating bodies which are electrically connected in parallel and are aligned in a direction perpendicular to a direction in which the fixing belt moves; and (i) positive temperature coefficient elements connected in series with whole of or some of the plurality of small heat-generating bodies in a power supply path from a power source or (ii) a single positive temperature coefficient element connected in series with some of the plurality of small heat-generating bodies in a power supply path from the power source, in an area corresponding to a non-sheet passing area of the fixing belt, the non-sheet passing area being an area where a smallest-size sheet does not pass, the smallest-size sheet being smallest among sheets that the fixing apparatus deals with, the positive temperature coefficient element(s) having a resistance value increasing at a predetermined temperature or higher.

2. The fixing apparatus as set forth in claim 1, wherein:

the positive temperature coefficient elements and part of the plurality of small heat-generating bodies are provided, respectively, so as to be connected in series with the power source.

3. The fixing apparatus as set forth in claim 1, wherein:

the single positive temperature coefficient element and at least one pair of the plurality of small heat-generating bodies are provided so as to be connected in series with the power source, said at least one pair being provided so as to be point-symmetric with respect to a center of alignment of the plurality of small heat-generating bodies.

4. The fixing apparatus as set forth in claim 1, wherein the following relationship is satisfied:

$$T2<T1,$$

where T1 is a self control temperature and T2 is a fixing control temperature, the self control temperature being the predetermined temperature at which the resistance value of the positive temperature coefficient element(s) increases, the fixing control temperature being a temperature of the fixing belt at which temperature fixing is carried out.

5. An image forming apparatus, comprising a fixing apparatus as set forth in claim 1.

6. The image forming apparatus as set forth in claim 5, further comprising:

temperature changing means for changing T2 so that (i) T2 is higher than T1 during warm-up of the image forming apparatus and (ii) T2 is lower than T1 after the warm-up is completed, T1 being a self control temperature which is the predetermined temperature at which the resistance value of the positive temperature coefficient element(s) increases, T2 being a fixing control temperature which is a temperature of the fixing belt at which temperature fixing is carried out.

7. A fixing apparatus, comprising:

a fixing member which is rotatable;

a heating member which is curved and includes a planar heat-generating body; and a fixing belt which is endless and moves while getting in contact with the fixing member and the heating member, the fixing member and the heating member being arranged such that a concave curved surface of the heating member faces the fixing member, the planar heat-generating body, including:

a resistive heat-generating body which extends in a direction perpendicular to a direction in which the fixing belt moves;

a plurality of small electrodes, provided on one side surface of the resistive heat-generating body in a direction in which the resistive heat-generating body extends, which are electrically separated from each other and cause current to flow through the resistive heat-generating body in a direction parallel to the direction in which the fixing belt moves;

an electrode, provided on the other side surface of the resistive heat-generating body, which is grounded; and (i) positive temperature coefficient elements connected in series with whole of or some of the plurality of small electrodes in a power supply path from a power source or (ii) a single positive temperature coefficient element connected in series with some of the plurality of small electrodes in a power supply path from the power source, in an area corresponding to a non-sheet passing area of the fixing belt, the non-sheet passing area being an area where a smallest-size sheet does not pass, the smallest-size sheet being smallest among sheets that the fixing apparatus deals with, the positive temperature coefficient element(s) having a resistance value increasing at a predetermined temperature or higher.

8. The fixing apparatus as set forth in claim 7, wherein:

the positive temperature coefficient elements and part of the plurality of small electrodes are provided, respectively, so as to be connected in series with the power source.

9. The fixing apparatus as set forth in claim 7, wherein:

the single positive temperature coefficient element and at least one pair of the plurality of small electrodes are provided so as to be connected in series with the power source, said at least one pair being provided so as to be point-symmetric with respect to a center of alignment of the plurality of small electrodes.

10. The fixing apparatus as set forth in claim 7, wherein the following relationship is satisfied:

$$T2<T1,$$

where T1 is a self control temperature and T2 is a fixing control temperature, the self control temperature being the predetermined temperature at which the resistance value of the positive temperature coefficient element(s) increases, the fixing control temperature being a temperature of the fixing belt at which temperature fixing is carried out.

11. An image forming apparatus, comprising a fixing apparatus as set forth in claim 7.

12. The image forming apparatus as set forth in claim 11, further comprising:

temperature changing means for changing T2 so that (i) T2 is higher than T1 during warm-up of the image forming apparatus and (ii) T2 is lower than T1 after the warm-up is completed, T1 being a self control temperature which is the predetermined temperature at which the resistance value of the positive temperature coefficient element(s) increases, T2 being a fixing control temperature which is a temperature of the fixing belt at which temperature fixing is carried out.

* * * * *